US005864920A

United States Patent [19]

Lasson et al.

[11] Patent Number: 5,864,920

[45] Date of Patent: Feb. 2, 1999

[54] DOOR CLOSER FOR THE NON-FIRE SIDE OF A FIRE-DOOR SAFETY INSTALLATION

[75] Inventors: Rex H. Lasson, Princeton; William L. Downey, Peru; Roderick A. L. Ross, Princeton, all of Ill.

[73] Assignee: Schlage Lock Company, San Francisco, Calif.

[21] Appl. No.: 7,312

[22] Filed: Jan. 15, 1998

Related U.S. Application Data

[63] Continuation of Ser. No. 690,403, Jul. 25, 1996, Pat. No. 5,709,009, which is a continuation of Ser. No. 233,107, Apr. 25, 1994, abandoned.

[51] Int. Cl.[6] ..... E05F 1/08

[52] U.S. Cl. ..... 16/79; 16/48.5; 16/71; 16/51; 16/DIG. 17; 49/501

[58] Field of Search ..... 16/79, 71, 72, 16/78, 80, 51, 49, 52, DIG. 17, DIG. 21, 48.5, 222; 292/DIG. 12, DIG. 15; 49/137, 339, 345, 3, 7, 501

[56] References Cited

U.S. PATENT DOCUMENTS

| | | | |
|---|---|---|---|
| 2,043,198 | 6/1936 | Heverly | 16/48.5 |
| 2,954,106 | 9/1960 | Schlage | 16/48.5 |
| 3,546,734 | 12/1970 | Pollack et al. | 16/52 |
| 3,644,209 | 2/1972 | Nowotny et al. | 252/78 |
| 3,657,128 | 4/1972 | Street | 252/78 |
| 3,875,612 | 4/1975 | Poitras | 16/48.5 |
| 3,934,306 | 1/1976 | Farris | 16/48.5 |
| 4,148,111 | 4/1979 | Lieberman | 16/59 |
| 4,161,804 | 7/1979 | D'Hooge et al. | 16/48.5 |
| 4,179,092 | 12/1979 | Miyazawa | 16/71 |
| 4,256,293 | 3/1981 | Burgess | 16/52 |
| 4,267,619 | 5/1981 | Suska | 16/48.5 |
| 4,360,443 | 11/1982 | Durr, Jr. | 252/76 |
| 4,831,687 | 5/1989 | Lin et al. | 16/49 |
| 4,967,444 | 11/1990 | Korling et al. | 16/48.5 |
| 5,187,835 | 2/1993 | Lee | 16/52 |

FOREIGN PATENT DOCUMENTS

| | | |
|---|---|---|
| 0 545 680 | 6/1993 | European Pat. Off. . |
| 2 303 934 | 8/1973 | Germany . |
| 4 134 509 | 4/1993 | Germany . |
| 1 103 966 | 2/1968 | United Kingdom . |
| 1 531 869 | 11/1978 | United Kingdom . |
| 2 052 621 | 1/1981 | United Kingdom . |
| 2 156 950 | 10/1985 | United Kingdom . |

*Primary Examiner*—Chuck Y. Mah
*Attorney, Agent, or Firm*—Michael H. Minns; Robert F. Palermo

[57] ABSTRACT

A door control device for use on a non-fire side of a fire-door mounted in a door frame in a fire-door safety installation has a door closer assembly filled with a hydraulic damping fluid and attached to a non-fire side of the fire-door by at least one fastener; a door control arm pivotally connected to the door frame at a first end and to the door closer assembly at a second end; and the hydraulic damping fluid is one of a group of fire resistant hydraulic fluids.

8 Claims, 1 Drawing Sheet

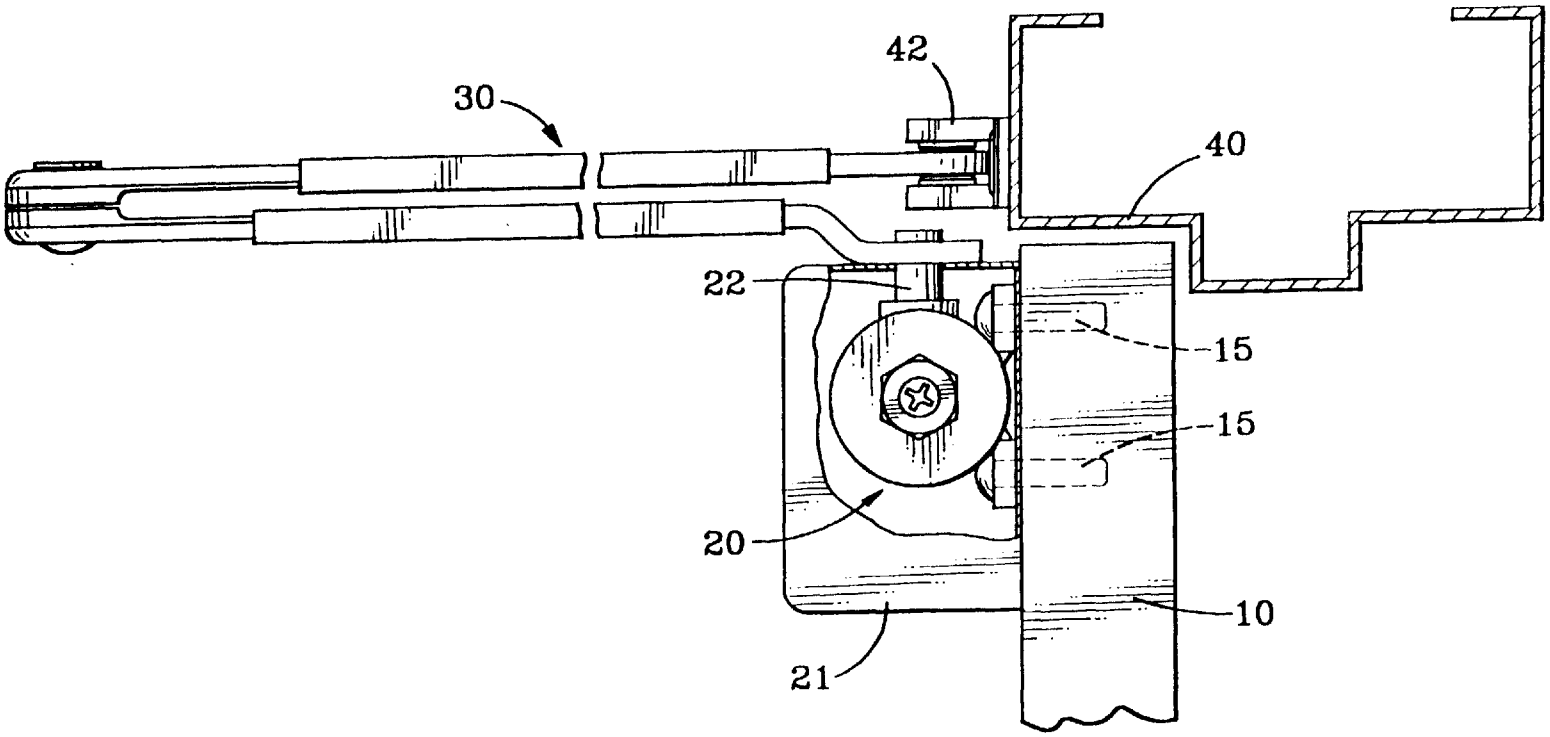
40
42
30
22
15
15
20
10
21

DOOR CLOSER FOR THE NON-FIRE SIDE OF A FIRE-DOOR SAFETY INSTALLATION

CROSS REFERENCE TO RELATED APPLICATIONS

This application is a continuation of U.S. patent application Ser. No. 08/690,403 filed Jul. 25, 1996, now U.S. Pat. No. 5,709,009, which is a continuation of U.S. patent application Ser. No. 08/233,107 filed Apr. 25, 1994, now abandoned, which applications are specifically incorporated by reference.

BACKGROUND OF THE INVENTION

This invention relates generally to hydraulic fluid damped door closers and more particularly to fire resistant door closers incorporating features which discourage transfer of fire through a fire door.

Fire doors are designed to protect against passage of fire from one room to another in a building. In the U.S., the National Fire Protection Association promulgates construction and installation standards for fire doors and windows as a publication, NFPA 80. Listed fire doors are classified in twelve categories, and protection of an opening depends upon the use of a listed fire door, a listed frame, listed door hardware, and a listed door control device as specified under each door type. Fire classifications for buildings are specified in model building codes, government regulations, and state and local building codes. Fire door classifications are expressed in hourly ratings according to the Standard for Fire Tests of Door Assemblies—UL 10B, ANSI A2.2, ASTM E—152, CSFM 43.7, CAN4-S104 (ULC-S104), UBC 43-2-1991, and NFPA 252.

The classifications are determined by exposing the doors to fire testing under standard conditions, and hourly ratings indicate the duration of exposure which the door can withstand, such as 4, 3, 2, 1½, 1, ¾ hours, and 30 or 20 minutes. It is permissible to test a fire door with special hardware and installation. This is usually done by door manufacturers who wish to establish a fire rated door, frame, door control, and hardware combination which can be specified in a building contract. It should be noted that, although there are several very similar fire door assembly tests in use throughout the world, there is no single international fire test standard.

Generally, fire doors must be maintained closed and latched or must automatically close and latch under a broad range of fire exposure conditions in order to properly serve their fire protective function. Thus, the door control device must assure that the door closes after it has been opened, and the latch must maintain the door latched. Today, all fire door tests are performed without a door control device.

Most currently used door control devices employ hydraulic damping technology to control opening and closing speed of the door. The hydraulic fluid is commonly a petroleum based oil which is relatively inexpensive, plentiful, non-corrosive, and compatible with a wide range of metals and other materials. However, petroleum oils have an auto-ignition temperature ranging between approximately 500 and 750 degrees F. and may contribute to the spread of the fire, if exposed to high temperatures, even when the door control device is mounted on the non-fire side of the door.

Within a few minutes after a fire begins, assuming it is adjacent to a fire door, the temperature of the door control device on the non-fire side of the door begins to increase by conduction through the door. This causes the hydraulic fluid to expand, to leak around the seals of the door control device, and to run down the door. Approximately 10 to 15 minutes after the fire starts, the temperature on the non-fire side of the door is high enough to cause auto-ignition of the leaking fluid. Even though the door and frame assembly may have a fire rating of 2 hours, or more, the fire has transferred through the door in less than 15 minutes.

The foregoing illustrates limitations known to exist in present door control devices. It would be advantageous to provide an alternative directed to overcoming one or more of those limitations. Accordingly, a suitable alternative is provided including features more fully disclosed hereinafter.

SUMMARY OF THE INVENTION

In one aspect of the present invention, a door control device is provided for use on a non-fire side of a fire-door mounted in a door frame in a fire-door safety installation, including a door closer assembly filled with a hydraulic damping fluid and attached to a non-fire side of the fire-door by at least one fastener; a door control arm pivotally connected to the door frame at a first end and to the door closer assembly at a second end; and, the hydraulic damping fluid comprises a fire resistant hydraulic fluid.

The foregoing and other aspects will become apparent from the following detailed description of the invention when considered in conjunction with the accompanying drawings.

BRIEF DESCRIPTION OF THE DRAWINGS

The sole figure is a fragmentary schematic elevational partially sectional view of a door control device according to a preferred embodiment of this invention.

DETAILED DESCRIPTION

Ideally, all that is required for a door control for use on the non-fire side of a fire door is a hydraulic fluid which is completely impervious to heat, pressure, or combinations thereof which may cause auto-ignition, fluid leakage, viscosity degradation, boiling, or any of a myriad of breakdown mechanisms. In reality, virtually any hydraulic fluid can be made to ignite under some conditions, and to differing extents, all fluids contribute to corrosion or other attack upon the seals and other components. However, depending on the compositions of the seals and other parts of the door control, a fluid having adequate compatibility of properties can usually be found.

There are four groups of fire resistant fluids currently available for hydraulic applications. These are generally categorized according to the relative amounts of oil and water contained, general resistance to temperature variation, compatibility with seal materials, wear protection afforded, and resistance to fluid breakdown. Although all presently available fluids will burn under certain conditions, the fire hazard has been reduced in fire resistant fluids to a sufficient degree to render them acceptable in appropriate applications.

According to one standard of fire safety, Group I fluids include inhibited water-glycol fluids with other additives, such as basic amine doped diethylene glycol, diethylene polyglycol, polyalkaline glycol, and mixtures thereof. They do not generally attack ordinary packings and seals used in pumps and valves. Loss of water content in normal use through evaporation is reflected in an increase in viscosity of the fluid and consequent improper function of the hydraulic device. This serves as an automatic safeguard, in that equipment becomes inoperable before the fire hazard of the material is significantly increased by the decrease in water content.

Group II includes synthetics, such as phosphate-ester fluids, phosphate-ester based fluids, and halogenated hydrocarbon based fluids. These are stable homogeneous compounds in which characteristics do not change appreciably throughout their operational life. Since regular pump seals, packings, and gaskets may be attacked by these fluids, they should be replaced with materials that will not be so affected.

Water-oil emulsions are included in Group III. They present considerably lower fire hazard than all mineral oil, but because of proportions, the emulsion must be carefully maintained. Separation of oil from the emulsion may be caused by contamination of the system by chemical cleaners or solvents, temperatures above 150 degrees F. or below 50 degrees F., high pressure (1500–2000 PSI), and prolonged equipment shutdown or drum storage. It is, therefore, very important to adhere strictly to the manufacturer's instructions regarding use and maintenance of the emulsion.

Group IV are the high water base fluids containing 70%, or more, of water. They have excellent fire resistance. They are, generally, made by adding synthetics or soluble oils to water. Because of the high water content, strict adherence to the manufacturer's instructions is very important to avoid premature component wear or failure.

In the preferred embodiment of the present invention, the water-glycol fluids of Group I were selected due to their overall combination of properties. They are not compatible with lead, tin, zinc, cadmium, or magnesium and will cause corrosion and will degrade in contact with these materials. However, the materials from which door controls are made (aluminum, copper, brass, cast iron, steel) are not corroded by contact with the water-glycol mixtures. In addition, standard seal materials such as rubbers, Buna N, Buna S, and Neoprene, silicones, and PTFEs work well with water-glycols because they do not absorb water. Thus, most water resistant sealants are suitable for applications with the water-glycol family of fluids. For lubrication, only greases having good water tolerance such as lithium, calcium, and aluminum complex greases should be used. Water-glycol fluids are safe for handling since they have no nitrosamines, nitrates, nor any other suspected or established carcinogens. The composition is 41% water and a balance of diethylene-polyglycol with a basic amine corrosion inhibitor.

It should be noted that, for most standard fire door applications, the Group I water-glycols are adequate in all respects; however, there are also applications for which fluids from Groups II, III, or IV will be preferred due to special materials or service requirements. In any case, the choice of fluid will be made by considering at least the factors enumerated above with respect to the preferred embodiment.

Referring to the sole figure of drawing, a door closer according to the present invention is shown. A door 10 is hung within a door frame 40 to pivot on hinges which are not illustrated. A door control device 20 is mounted to the face of the door 10 on the non-fire side of door 10 and is concealed and protected by cover 21. Door control pinion 22 extends through cover 21 and engages one end of door control arm 30, the other end of which is pivotally attached to door frame pivot 42. Door control device 20 is attached to the door 10 by means of one or more fasteners 15 which are made from a material which is structurally strong enough to support the door control device 20. The door control device 20 is filled with a fire resistant hydraulic fluid.

Use of fire resistant damping fluid alone in accordance with this invention serves the purpose of preventing or retarding the transfer of fire to the non-fire side of a fire door. However, enhanced fire resistance can be obtained by using in combination a fire resistant damping fluid in accordance with this invention with one or more additional features disclosed in copending application Ser. No. 08/690,403 cited supra.

What is claimed is:

1. A fire safety installation having a fire side and a non-fire side, said fire safety installation comprising:

(a) a door frame;

(b) a fire door mounted in said door frame; and (c) a door control device mounted on the non-fire side of said fire safety installation, said door control device comprising:

a door closer assembly attached to said non-fire side of said fire door by at least one fastener, said door closer assembly comprising a door closer having a body filled with a hydraulic damping fluid; and a door control arm pivotally connected to said door frame at a first end and to said door closer assembly at a second end;

wherein:

said hydraulic damping fluid is a selected fire resistant hydraulic fluid.

2. A fire safety installation according to claim 1 wherein said door is normally closed.

3. A fire safety installation according to claim 1 wherein said door is pivotally mounted.

4. A fire safety installation according to claim 3 wherein said fire side is an inward side and said non-fire side is an outward side, and wherein said door is openable outwardly.

5. A fire safety installation according to claim 1, wherein said fire resistant hydraulic fluid is an inhibited water-glycol fluid selected from the group consisting of basic amine doped diethylene glycol, diethylene polyglycol, polyalkaline glycol and mixtures thereof.

6. A fire safety installation according to claim 1, wherein said fire resistant hydraulic fluid is a synthetic fluid selected from the group consisting of phosphate-ester fluids, phosphate-ester based fluids, and halogenated hydrocarbon based fluids.

7. A fire safety installation according to claim 1, wherein said fire resistant hydraulic fluid is selected from the group consisting of water emulsions of mineral oils.

8. A fire safety installation according to claim 1, wherein said fire resistant hydraulic fluid is selected from the group consisting of high water base solutions of synthetics and soluble oils.

* * * * *

UNITED STATES PATENT AND TRADEMARK OFFICE

CERTIFICATE OF CORRECTION

PATENT NO. : 5,864,920

DATED : Feb. 2, 1999

INVENTOR(S) : Lasson, et al.

It is certified that error appears in the above-identified patent and that said Letters Patent is hereby corrected as shown below:

On the title page, item [75], delete "Roderick A. L. Ross, Princeton"

Signed and Sealed this

Thirty-first Day of August, 1999

*Attest:*

Q. TODD DICKINSON

*Attesting Officer*

*Acting Commissioner of Patents and Trademarks*